US006455815B1

(12) United States Patent
Melgaard et al.

(10) Patent No.: US 6,455,815 B1
(45) Date of Patent: Sep. 24, 2002

(54) MAGNETIC ANNEALING OVEN AND METHOD

(75) Inventors: Hans L. Melgaard, North Oaks; Paul J. Haas, White Bear Lake, both of MN (US)

(73) Assignee: Despatch Industries, L.L.P., Minneapolis, MN (US)

( * ) Notice: Subject to any disclaimer, the term of this patent is extended or adjusted under 35 U.S.C. 154(b) by 0 days.

(21) Appl. No.: 10/008,040

(22) Filed: Nov. 8, 2001

(51) Int. Cl.[7] ..... F27B 5/14

(52) U.S. Cl. ..... 219/390; 219/393; 219/400; 148/108; 148/121

(58) Field of Search ..... 219/390, 393, 219/400; 148/108, 121

(56) References Cited

U.S. PATENT DOCUMENTS

| | | | | |
|---|---|---|---|---|
| 1,102,197 A | | 6/1914 | Knox | |
| 4,161,959 A | | 7/1979 | Jansen et al. | |
| 4,427,378 A | | 1/1984 | Bowers | |
| 4,649,248 A | * | 3/1987 | Yamaguchi et al. | 219/10.57 |
| 4,660,593 A | | 4/1987 | Langhe | |
| 4,787,844 A | | 11/1988 | Hemsath | |
| 4,840,559 A | | 6/1989 | Hemsath | |
| 5,192,849 A | * | 3/1993 | Moslehi | 219/121.43 |
| 5,203,929 A | * | 4/1993 | Takayanagi et al. | 148/121 |
| 5,256,061 A | | 10/1993 | Cress | |
| 6,013,905 A | | 1/2000 | Oster | |
| 6,166,354 A | * | 12/2000 | Hause et al. | 219/390 |

OTHER PUBLICATIONS

Brochure, "Magnetic Annealing Tool", Despatch Industries, L.L.P., 6 pp. (date unknown, but believed to be early 1998).

* cited by examiner

*Primary Examiner*—Teresa Walberg
*Assistant Examiner*—Shawntina T. Fuqua
(74) *Attorney, Agent, or Firm*—Fredrikson & Byron, P.A.

(57) ABSTRACT

An oven for magnetic annealing of magnetic media, along with methods for using the same. The oven has a vacuum chamber with vacuum port for loading and unloading magnetic media. The vacuum port is sealed by a vacuum seal or door adapted for movement between open and closed positions. A vacuum pump is connected to the chamber to provide a vacuum within the chamber. The oven includes a heat exchanger adapted to receive magnetic media and a heat transfer gas unit connected to the heat exchanger to form a closed, hermetically sealed heat transfer gas circuit for heating and cooling magnetic media loaded in the heat exchanger. A magnet located exterior to the vacuum chamber provides the magnetic field to magnetic media. Methods of the invention include the steps of loading magnetic media into the heat exchanger of the oven, closing the door to create a vacuum seal, generating a vacuum within the chamber, circulating heat transfer gas through the heat transfer gas circuit to ramp-up to the annealing temperature, providing a magnetic field of greater than 0.25 Tesla, holding the temperature at the annealing temperature to allowing the magnetic material of the magnetic media to assume the desired orientation, ramping down the temperature to cool the magnetic media to preserve the desired orientation, ramping down and removing the magnet field, and reintroducing atmosphere into the chamber. The magnetic media can then be unloaded.

24 Claims, 4 Drawing Sheets

10
12
14
16
18
22
24
26
28
30
32
34
40
42
44
50
52A
52B
53
54
55
56

MAGNETIC ANNEALING OVEN AND METHOD

FIELD OF THE INVENTION

The invention is directed to an oven used to anneal magnetic media for electronic applications and to methods of magnetic annealing employing the oven.

BACKGROUND OF THE INVENTION

Magnetic vacuum ovens have been used in the manufacture of devices such as read/write heads for rigid media storage devices, e.g., magnetic resistive (MR) and giant magnetic resistive (GMR) heads, disk drives, "MRAM" wafers, and the like. Such magnetic media are referred to as wafers and typically are formed of a substrate bearing magnetic film or layers to which a particular magnetic orientation has been imparted through exposure to magnetic fields at elevated temperatures. The process of imparting a particular magnetic orientation in this manner is known as annealing or magnetic annealing.

In the annealing process, the magnetic media or wafers are heated to make them more susceptible to magnetic fields. The magnetic film or layers contain ferromagnetic material having a crystalline structure. Raising the temperature increases the vibrational moments of atoms forming the crystalline structure of the magnetic material and imparts a randomness to the motion of the atoms, weakening the crystalline structure of the ferromagnetic material in the magnetic film or layers. This places the atoms in a state that provides minimal resistance to the influence of an outside magnetic field. Exposing the heated wafers to a magnetic field causes the atoms to be held in place or oriented along the axis of the magnetic field. After subjecting the atoms or crystals of the magnetic media to elevated temperatures in the presence of a magnetic field of a desired strength for a prescribed period of time, the wafers are cooled, thus fixing or locking the atoms or crystals in the orientation imparted by the magnetic field. Thus, magnetic annealing involves both heating the media and subjecting the media to an magnetic field so as to orient the crystals of the magnetic film or layers thereof.

The magnetic annealing process may be carried out on a single wafer or on multiple wafers in batches or lots. The magnetic field can be generated by a permanent magnet, electromagnet or superconducting electromagnet. Such magnets have been incorporated into vacuum ovens. However, permanent magnets are heat sensitive, losing their magnetism at temperatures above their Curie point, and hence should not be positioned too closely to sources of heat. Though permanent magnets are utilized, electromagnets and superconducting electro-magnets are particularly well-suited for placement external to the chamber of a vacuum oven.

Despatch Industries, Inc. currently has commercially available annealing ovens, Model MT-300 and Model MT-500, that incorporate permanent magnets, electromagnets and superconducting electromagnets. Wafers are loaded onto individual shelves of a cassette that is placed into a carrier that may remain resident within the oven chamber at all times or may be removed from the chamber for loading and unloading. The carrier has a separate door which must be sealed prior to the beginning of the heating cycle. The entire carrier is made out of metal, but there is an elastomeric seal between the door and the rest of the carrier. The door of the carrier seals the carrier to prevent convective heat transfer between a heat transfer gas introduced into the chamber and the magnetic media within the carrier, and to minimize oxidation of the wafers. The chamber is filled with heated gas to raise the temperature of the carrier and the media therein to a desired annealing temperature through conductive heat transfer. A magnetic field is generated by magnets located outside of the oven chamber. The chamber is sealed with a door that typically also has an elastomeric seal. The desired temperatures for annealing typically are in excess of 300° C. At these temperatures, the elastomeric seals tend to fail over time after a number of cycles. Consequently, the vacuum within the carrier cannot be properly maintained without necessary replacement of the elastomeric chamber door seal. In order to protect the magnetic media from exposure to convective heat and oxidation, replacement of the carrier door seal is also necessary.

It is therefore desirable to provide an magnetic annealing oven, that avoids the production losses resulting from seal failures and the process disruptions and downtime associated with seal replacement.

SUMMARY OF THE INVENTION

The present invention is directed to ovens for annealing magnetic media. The oven of the invention generally comprises a vacuum chamber formed of non-magnetic material having a heat exchanger disposed therein, and a magnet external to the chamber. The heat exchanger is connected to a heat transfer gas unit to form a closed heat transfer gas circuit. Magnetic media loaded in the heat exchanger are primarily heated and cooled by conductive heat transfer.

In an embodiment of the invention, the oven has a vacuum chamber formed of nonmagnetic material and a vacuum port with a vacuum seal through which magnetic media may be loaded and unloaded. Supported in the vacuum chamber is a heat exchanger which is also formed of non-magnetic material. The heat exchanger has a first compartment with an opening for receiving magnetic media to be treated in the oven and a second compartment in thermally conductive relationship with the first compartment. The second compartment has an airtight volume hermetically sealed from the first compartment and the vacuum chamber. The heat exchanger is spaced from the vacuum port so as to avoid heating of the vacuum seal to seal-damaging temperatures. Heat transfer gas is circulated to and from the second compartment by heat transfer conduits that are hermetically sealed from the vacuum chamber and the first compartment. An exterior magnet is positioned to induce a magnetic field in magnetic media disposed in the heat exchanger.

In another embodiment of the invention the vacuum chamber is formed of non-magnetic material and is adapted to receive and has disposed therein a heat exchanger formed of non-magnetic material. The heat exchanger includes first and second compartments. The first compartment is adapted to receive magnetic media and the second compartment has an airtight volume hermetically sealed from the first compartment and the vacuum chamber. A vacuum pump is connected to the vacuum chamber and is capable of providing a vacuum of at least $10^{-7}$ Torr within the chamber. The heat transfer gas unit has heat transfer conduits connected to the second compartment of the heat exchanger to form a heat transfer gas circuit hermetically sealed from the vacuum chamber and the first compartment. The conduits supply heating and cooling gas to the second compartment. The first compartment is in thermal communication with the second compartment allowing conductive heat transfer between the gas supplied to the second compartment, the first compartment, and the magnetic media disposed therein. A magnet for inducing a magnetic field of greater than 0.25 Tesla in magnetic media disposed in the heat exchanger is located exterior to the chamber and positioned to induce the magnetic field along the center line of magnetic media disposed in the heat exchanger.

In another embodiment of the invention, the heat exchanger of the oven is located within, and is an integral part of the chamber, is spaced rearwardly of the door, and is adapted for hermetically sealed connection to the heat transfer gas unit external to the chamber.

In another embodiment of the invention, the heat exchanger of the oven is adapted to receive a carrier into which magnetic media are loaded.

The invention is further directed to a method of annealing magnetic media. The method comprises providing an oven according to the invention, loading magnetic media into the heat exchanger of the oven, closing the oven door to create a vacuum seal, ramping up to a vacuum of at least $10^{-7}$ Torr within the chamber, ramping the temperature of the magnetic media to a target annealing temperature at a rate consistent with uniform heat transfer to the magnetic media, ramping up the magnetic field so as to provide a magnetic field of greater than 0.25 Tesla in the magnetic media disposed in the heat exchanger, holding the magnetic media at the target temperature while maintaining the magnetic field and the vacuum in the chamber, allowing the magnetic material of the magnetic media to assume a desired orientation, cooling the magnetic media to preserve the orientation of the magnetic material, ramping down and removing the magnetic field, ramping down the vacuum to gradually reintroduce atmosphere within the chamber; and unloading the magnetic media.

DETAILED DESCRIPTION OF THE PREFERRED EMBODIMENT

The magnetic annealing oven of the invention is utilized for magnetic annealing of magnetic media or wafers, such as read/write heads, disk drives, and the like. The oven may be relatively compact. During the magnetic annealing process, the oven is capable of generating a magnetic field of greater than 0.25 Tesla and desirably can cycle between room temperature and temperatures of about 525° C. in order to impart desired magnetic orientation to the magnetic media being processed.

Figure 1:
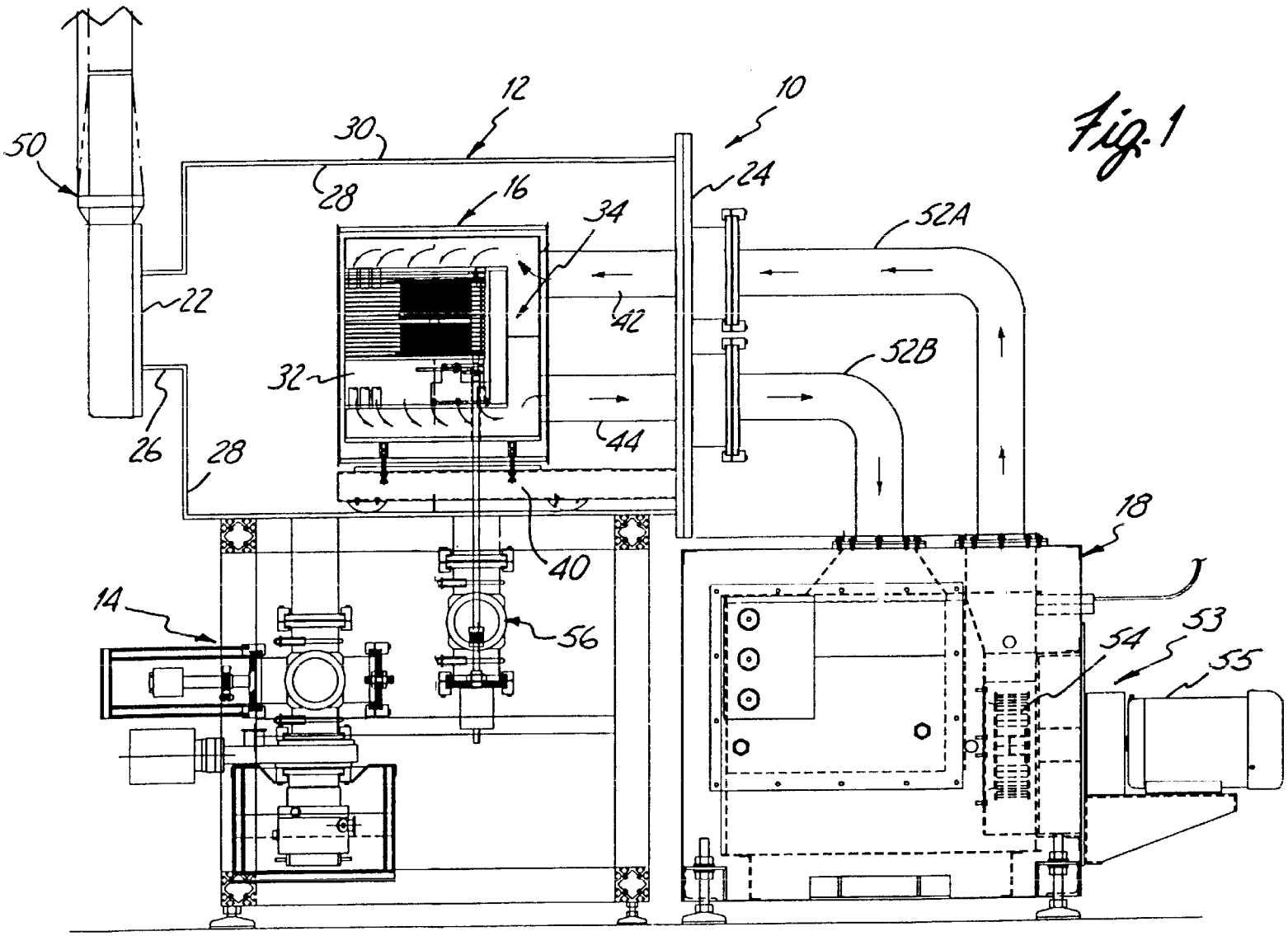
FIG. 1 is a side elevation view in partial cross-section of an oven according to the invention.

With reference to FIG. 1, the oven 10 of the invention is generally comprised of a vacuum chamber 12, a vacuum pump 14, a heat exchanger 16 disposed within the vacuum chamber, a heat transfer gas unit 18 connected to the heat exchanger 16 to supply heated gas to the heat exchanger and located outside the chamber, and a magnet 20 (not shown in FIG. 1) located exterior to the chamber.

The vacuum chamber 12 has an open front wall defining a vacuum port 22 for loading and unloading of magnetic media into and out of the heat exchanger, and a rear wall 24. The vacuum port 22 is, preferably, generally smaller than the overall dimensions of the chamber 12 but of sufficient size as to allow the loading and unloading of magnetic media into the heat exchanger 16 which is disposed within the chamber 12. As can be seen in FIG. 1, the port 22 defined by the open front wall may lead to a narrow throat 26 of substantially the same dimensions as the port 22 and similarly smaller than the overall dimensions of the portion of the chamber 12 in which the heat exchanger 16 resides. The narrow throat 26 in turn leads to the portion of the chamber 12 in which the heat exchanger resides.

The chamber 12 is made of non-magnetic materials of sufficient strength to withstand a high vacuum. Such materials include but are not limited to stainless steel, silver, copper, titanium and composites or alloys thereof. The chamber 12 is generally rectangular, but other shapes, such as a cylindrical shape, may also be utilized. Interior surfaces 28 of the chamber 12 preferably are highly polished so as to provide a low emissivity of less than 0.05. This is desirable to reduce heat radiation from the heat exchanger 16 to the chamber 12 and to the magnet 20 (FIG. 2) that is located outside of and in close proximity to exterior surfaces 30 of the chamber.

Figure 3:
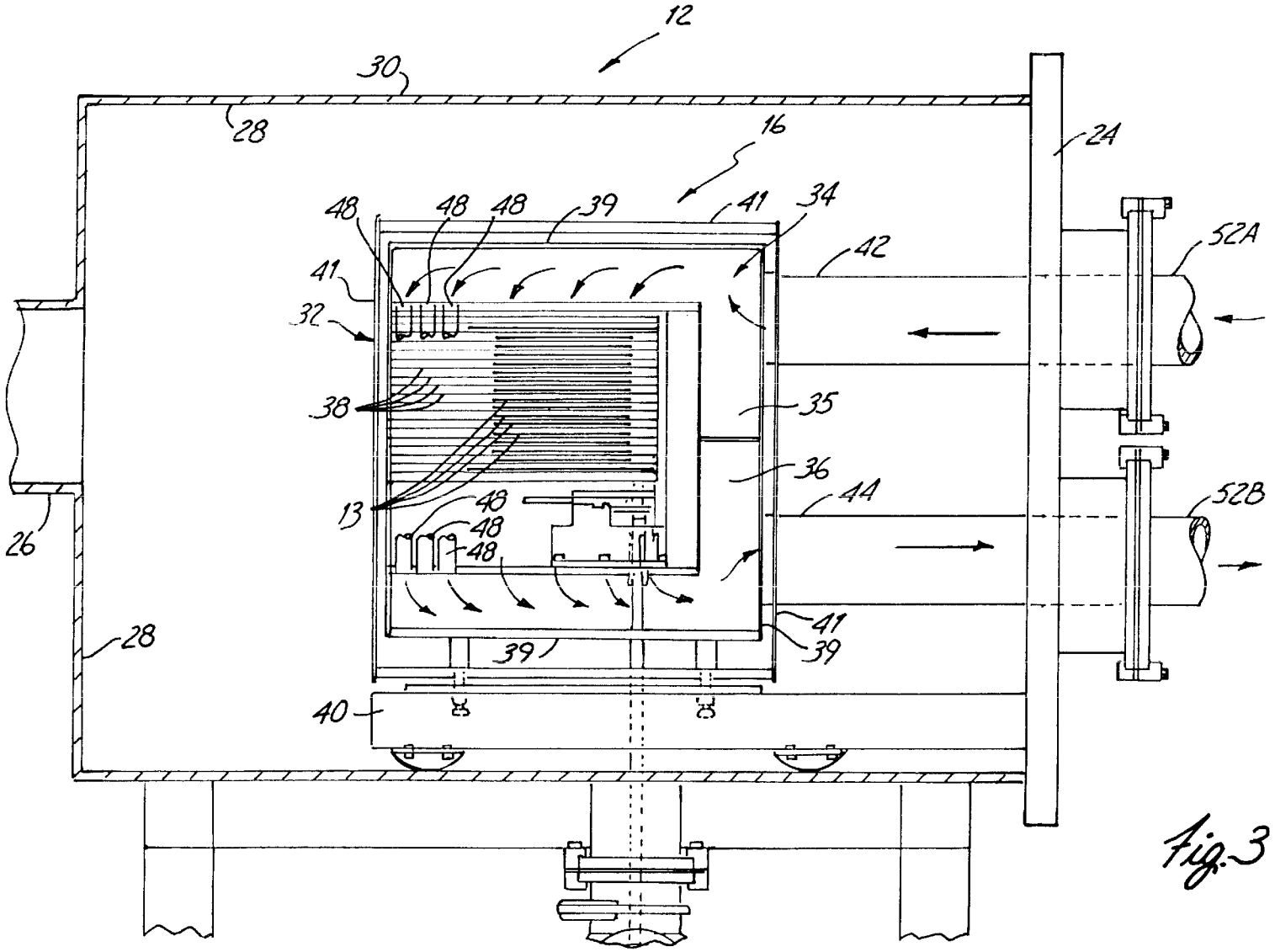
FIG. 3 is an enlarged, broken-away, side elevation view of a heat exchanger shown also in FIG. 1.

The vacuum chamber 12 has disposed therein a heat exchanger 16 formed of non-magnetic, thermally conductive material. The heat exchanger 16 is adapted to receive magnetic media 13 generally in the form of wafers or disks and is located generally centrally of the chamber 12. The heat exchanger 16 is spaced from the vacuum port or open front wall 22 so as to avoid heating of the vacuum seal to seal-damaging temperatures. In FIGS. 1 and 3, the heat exchanger 16 can be seen positioned within the chamber 12.

Figure 4:
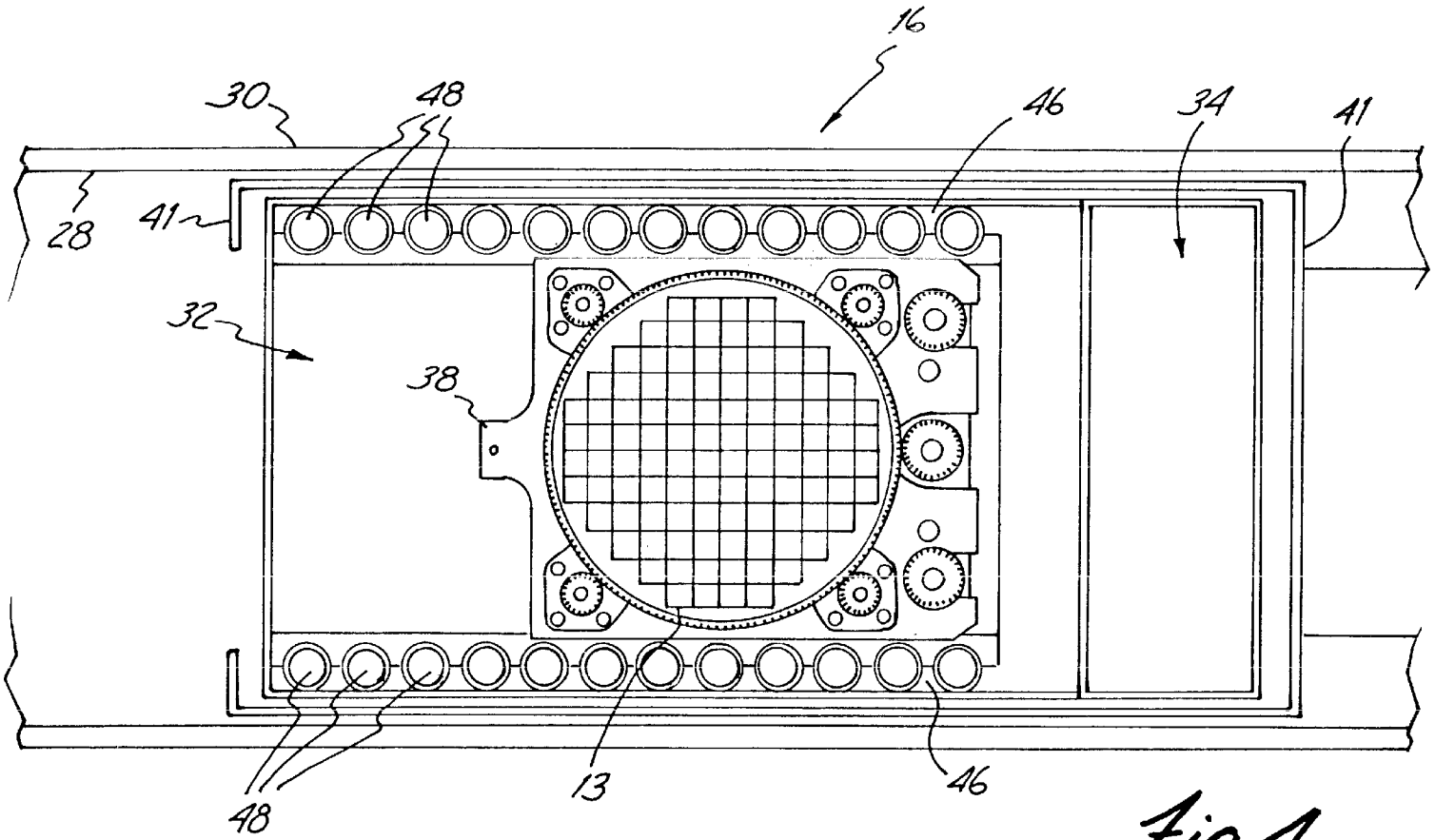
FIG. 4 is a top plan view of the heat exchanger of FIG. 3.

With reference to FIGS. 1, 3 and 4, the heat exchanger 16 is defined by first and second compartments 32 and 34 and is adopted to receive magnetic media into the first compartment. The first compartment 32 has an opening for receiving magnetic media and generally faces the vacuum port 22 to facilitate loading and unloading. The second compartment 34 is in thermally conductive relationship with the first compartment 32 and has an airtight volume hermetically sealed from the first compartment 32 and from the vacuum chamber 12. As shown best in FIG. 3, the second compartment 34 includes a first plenum 35 and a second plenum 36. The two compartments 32, 34 share a common heat-conductive wall and the first compartment 32 is at least partially surrounded by the second compartment 34. As thus described, the heat exchanger 16 may be a five-sided box-shaped container having an opening facing toward the port 22 of the chamber 12.

As shown in FIG. 3, within the first compartment 32 of the heat exchanger 16 are shelves 38 for receiving and holding the magnetic media 13 during the magnetic annealing process. The shelves 38 may be an integral part of the heat exchanger 16 or part of a removable carrier or cassette that can be loaded into the heat exchanger 16 while outside of the chamber 12 and then inserted into the first compartment 32 of the heat exchanger 16. The carrier or cassette is generally box-shaped and is slidably received into the interior of the heat exchanger 16. When the shelves are part of a carrier, the sides of the carrier and of the interior side walls of the heat exchanger 16 may bear mutually engaging flanges which allow the carrier to be slidably received. Further, the flanges allow for thermally conductive connection between the heat exchanger 16 and the carrier. The carrier, the heat exchanger 16 and the shelves 38 thereof are made of thermally conductive, non-magnetic materials which include but are not limited to stainless steel, silver, gold, copper, titanium, and composites or alloys thereof.

The heat exchanger 16 preferably is positioned so that there is a gap between the exterior walls 39 of the heat exchanger 16 and the interior surfaces 28 of the vacuum chamber 12. This gap aids in the prevention of conductive heat transfer from the heat exchanger 16 to the chamber 12 and, thus, to the magnet 20 located outside of the chamber 12. To further prevent the transfer of heat from the heat exchanger 16 to the chamber 12 and to the exterior of the chamber, at least one heat reflective shield 41 of non-magnetic material, such as those immediately described above, may also be located between the exterior walls of the heat exchanger 16 and the interior surface 28 of the vacuum chamber 12. Silver and gold are preferred materials for the reflective shield, with silver being the more preferred. The non-magnetic material of the shield 41 is highly polished to provide a heat reflective surface having a low emissivity of about 0.05 or less. The reflective shield 41 can be seen in FIG. 3 and FIG. 4. The reflective shield 41 as illustrated surrounds the exterior walls 39 of the heat exchanger 16 without obstructing the opening to the first compartment 32. The reflective shield 41 also serves to improve the uniformity of heat transfer between the heat exchanger 16 and the magnetic media. One or more reflective shields 41 may be incorporated into the oven 10 as the space between the chamber 12 and the heat exchanger 16 allows. The heat exchanger 16 may rest upon or be mounted to a support base 40 located in the bottom of the vacuum chamber.

As shown in FIG. 3, the second compartment of the heat exchanger 16 may be divided into two separate volumes that define a first and a second plenum 35, 36, which are respectively an inlet compartment portion and an outlet compartment portion of the second compartment 34. The first plenum 35 has an inlet 42 for receiving heat transfer gas from the heat transfer gas unit 18; and the second plenum 36 has an outlet 44 for returning heat transfer gas to the heat transfer gas unit 18. With reference to FIG. 4, the two side walls 46 of the heat exchanger 16 have a plurality of through-ports 48 to connect the first and second plenums 35, 36 in flow-through communication, allowing heat transfer gas to flow from the first plenum 35 to the second plenum 36. The plenums and their through-ports 48 communicate to provide a path for heat transfer gas to flow through the heat exchanger 16, permitting conductive heat transfer from the heat transfer gas to the heat exchanger 16. In turn, the magnetic media 13 are heated by conduction via the shelves 38 and, more predominantly at higher temperatures, by radiant heating from the shelves 38 and walls of the heat exchanger 16. Heat transfer gas flows from the heat transfer gas unit 18, through the heat exchanger 16 and back to the heat transfer gas unit 18 in a closed heat transfer gas circuit. The heat transfer gas does not otherwise enter into or flow within the vacuum chamber 12.

The port 22 of the vacuum chamber 12 is sealed by a door 50 having a vacuum seal and is adapted for movement between open and closed positions. Various door assemblies known to those skilled in the art may be utilized but must be able to provide and maintain an adequate seal at vacuums of at least $10^{-7}$ Torr. Preferably, the door 50 is adapted for vertical movement between open and closed positions in a guillotine fashion, such as high vacuum gate valves manufactured by VAT or other gate valve manufacturers. Such valves are commercially available and are typically round or square plates carrying an elastomeric seal. Alternatively, the elastomeric seal may be carried by the periphery of the port 22 of the chamber 12. In either case, the seal extends about the area of contact between the door 50 and the port 22 of the chamber 12.

The elastomeric seal is sensitive to heat and may deteriorate over numerous processing cycles due to exposure to elevated temperatures of about 300° C. or higher which in turn diminishes the oven's ability to maintain high vacuums. The closed heat transfer gas circuit protects the seal from such exposure by precluding convective heat transfer within the chamber 12. This extends the useful life of the seal which would otherwise have to be replaced due to frequent seal failure, resulting in undesirable downtime. The reflective shield 41, the low emissivity surface of the chamber 12 and the narrow throat 26 of the chamber 12, which allows a narrow view angle for exposure of the chamber door 50 to radiant heat, all serve to protect the elastomeric seal from heat.

As shown in FIG. 1, a vacuum pump 14 capable of providing a vacuum of at least $10^{-7}$ Torr is connected to the chamber 12. Vacuum pumps useful in an oven 10 according to the invention include, but are not limited to, turbo-molecular pumps and cryo-pumps. Turbo-molecular pumps are magnetically levitated and are sensitive to external magnetic fields. The magnetic fields generated by the magnet 20 of the oven 10 can disturb the magnetic levitation and cause the pump to go into a frictional mode, burning out the pump. If a turbo-molecular pump is utilized, it should not be located in relatively close proximity to the magnet 20; however, its effectiveness is diminished if operated at too great a distance from the oven 10. Due to this anomaly of turbo-molecular pumps, cryo-pumps are preferred. The vacuum pump 14 is regulated by a vacuum controller capable of ramping up to the desired vacuum pressure and of gradually reintroducing atmosphere into the chamber 12.

The magnetic field employed in magnetic annealing is generated by a magnet 20 disposed exterior to the chamber 12. A magnet 20 is represented in broken line in FIG. 2. The magnet 20 and the field it generates are regulated by a controller capable of ramping up and ramping down the magnetic fields for loading and unloading. Magnets useful in the oven 10 and the methods of the invention include permanent magnets, electromagnets, and superconducting electromagnets. The electromagnets may be single solenoid or dual solenoid magnets. The type of magnet 20 utilized will depend upon the desired magnetic field strength.

Permanent magnets may be suitable for applications requiring a magnetic field strength of up to about 0.5 Tesla. They are generally horseshoe-shaped and provide a magnetic field on an axis through the sides of the vacuum chamber 12. At magnetic fields much greater than 0.5 Tesla, a permanent magnet becomes an impractical and uneconomic choice due to the size and cost of the magnet. An electromagnet is well-suited for applications requiring a magnetic field of up to or slightly more than about 1.3 Tesla. For applications requiring magnetic fields much in excess of 1.3 Tesla, a superconducting electromagnet is preferred because it can be ramped up to field strengths of about 2.0 Tesla or more. In fact field strengths in excess of 2.0 Tesla can be achieved with superconducting electromagnets. Thus, with appropriate magnet selection, the oven 10 of the invention can provide magnetic fields of at least 0.25 Tesla and up to 2.0 Tesla or more. Both electromagnets and superconducting electromagnets allow for great variability and control of magnetic field strength.

Since electromagnets and superconducting electromagnets consume large amounts of energy to generate magnetic fields of greater than 1 Tesla, the vacuum chamber 12 is preferably compact so as to minimize the side-to-side width or the end-to-end length of the chamber. By minimizing the side-to-side width and/or the end-to-end length of the chamber 12, the distance through which the magnetic field must be induced is reduced, thereby reducing the amount of energy needed to impart the desired magnetic field to magnetic media during magnetic annealing. If the vacuum chamber 12 is not compact, the oven 10 of the invention is still operative; however, it would require significantly larger magnets and have a significantly greater energy demand in order to generate a magnetic field of sufficient strength across the width or length of the chamber 12 throughout the magnetic annealing cycle.

Figure 2:
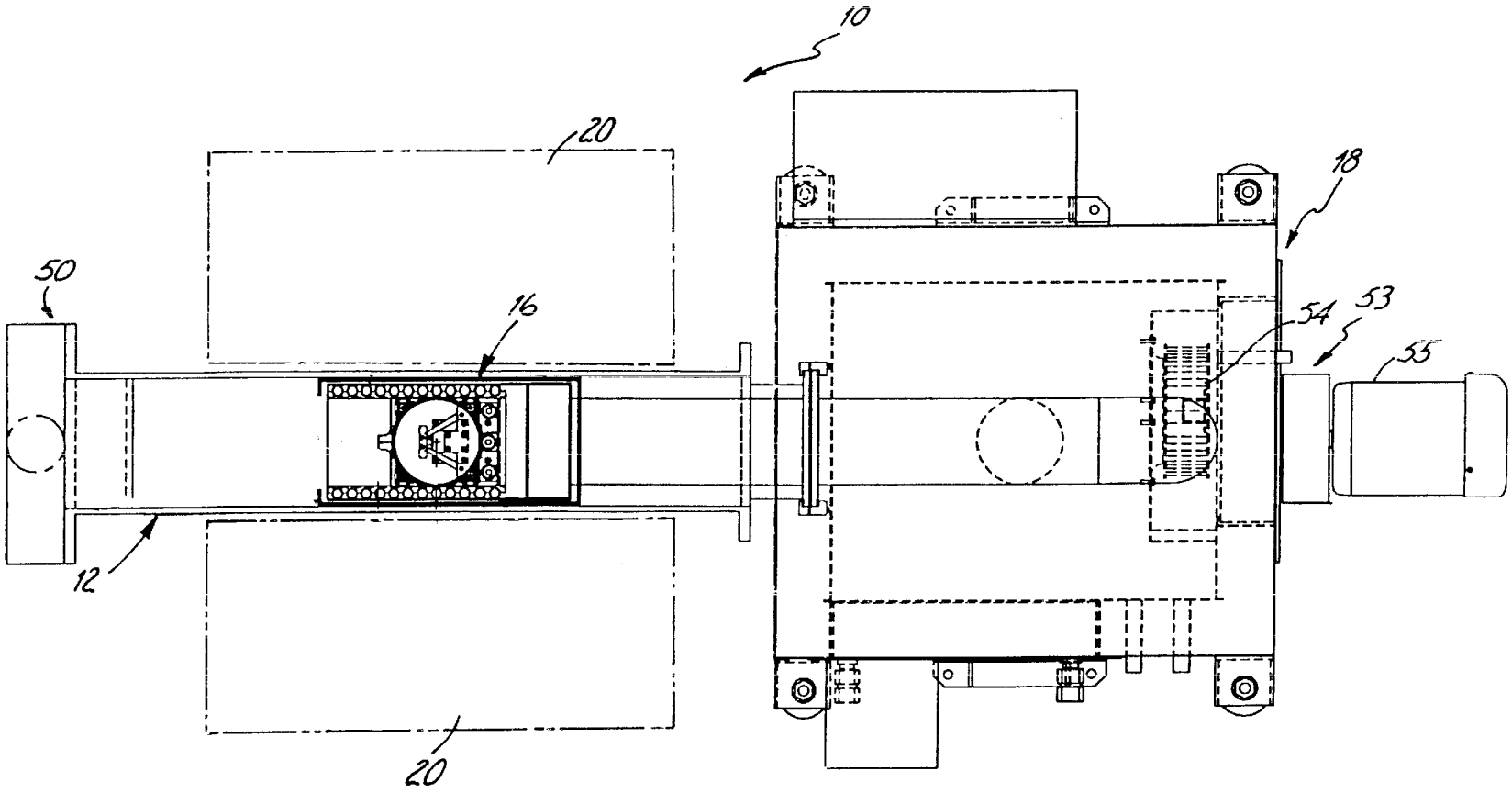
FIG. 2 is a top plan view of the oven shown in FIG. 1.

As shown in FIG. 2, the magnet 20 is located exterior to the chamber 12. Preferably, the magnet 20 is in close proximity to the area of the chamber 12 in which the heat exchanger 16 resides and is positioned to induce the magnetic field along the center line of the magnetic media within the heat exchanger. With a horseshoe-shaped permanent magnet or a dual solenoid magnet the flux lines of the magnetic field are induced across the side-to-side width of the chamber. And, with a single solenoid magnet the flux lines of the magnetic field are induced across the end-to-end length of the chamber. Thus, the axis of the magnetic field or the flux lines thereof is through the sides of the chamber 12 if a permanent or dual solenoid magnet is used or through the length of the chamber 12 if a single solenoid-type magnet, electromagnet or superconducting electromagnet, is used. In either case, the axis is always parallel to the plane of the magnetic media or wafers being processed in the oven 10 of the invention, rather than perpendicular to the plane of the magnetic media or wafers. Thus, the magnetic field is said to be along the center line of the magnetic media meaning that the axis of the magnetic field is parallel to the plane of the magnetic media or wafers. This provides for proper, even and uniform orientation of products processed in the oven 10.

By placing the magnet 20 in proximity to the heat exchanger 16, electromagnets and superconducting magnets as small as about 8 to about 12 inches from pole to pole can be utilized, resulting in cost saving for both energy and the magnets themselves. The magnet 20 is spaced away from the chamber 12 so that there is a gap between the magnet 20 and the chamber 12. The gap between the magnet 20 and the chamber 12 should preferably be no less than about 1 centimeter. This arrangement of the magnet 20 allows for precise magnetic field uniformity of ±2% with a divergence angle of <2°. Further, it prevents or minimizes the risk of conductive heat transfer from the heat exchanger 16 and chamber 12 to the magnet 20. Exposing the magnet 20 to heat may cause undesirable variations in the magnetic field and result in loss of uniformity of both the magnetic field generated and products processed in the oven 10.

Heating and cooling of the magnetic media or wafers is accomplished by circulating a heat transfer gas through the heat exchanger 16. Ambient air is adequate, but other gases can be utilized. As shown in FIG. 3, heat transfer conduits 52A, 52B from the heat transfer gas unit 18 are respectively connected to inlet 42 and outlet 44 of the second compartment 34 of the heat exchanger 16 to form a heat transfer gas circuit hermetically sealed from the vacuum chamber 12 and the first compartment 32. The conduits 52A, 52B supply heating and cooling gas to the second compartment 34 and return the gas to the heat transfer unit 18. The first compartment 32 is in thermal communication with the second compartment 34, allowing thermal conductive heat transfer between the second compartment 34, the first compartment 32 and the magnetic media 13 disposed in the heat exchanger 16. As shown in FIG. 1, the heat transfer gas unit 18 is connected, through conduits 52A, 52B, to the inlet 42 and outlet 44 of the heat exchanger 16 to provide heat transfer gas and to complete the heat transfer gas circuit which includes the heat exchanger 16 and the heat transfer gas unit 18.

The heat transfer gas unit 18 includes a gas circulation mechanism 53, such as a fan, blower or venturi for circulating heat transfer gas at a sufficient rate to effectively heat the magnetic media or wafers at a constant rate. As illustrated in FIGS. 1 and 2, the gas circulation mechanism 53 is a fan 54 driven by motor 55. The gas cycles through the heat exchanger 16 with no movement of the gas outside of the heat exchanger 16. The gas temperature is regulated by a temperature controller capable of ramping the temperature at rates consistent with uniform heat transfer to the magnetic media. A temperature sensing device or probe is located within the first compartment of the heat exchanger for sensing the temperature therein. The probe may be attached to a surface or structural element of the heat exchanger; or it may be attached to one or more magnetic media, e.g., wafers, loaded in the heat exchanger or to a placebo wafer in the heat exchanger to detect the actual temperature to which magnetic media is subjected during processing. The probe is coupled with a switch responsive to the probe for signaling the temperature controller to assure uniform heat transfer during ramp-up and ramp down and to maintain the annealing temperatures during processing. For typical magnetic annealing applications, temperature ramp-up and ramp-down rates of up to about 5° C. /minute are suitable. Uniform temperature gradients with a variation of no more than +1° C. in a vacuum environment can be obtained with the oven 10 of the invention.

The vacuums utilized for magnetic annealing are adequate to provide a generally anaerobic atmosphere within the oven chamber 12. However, some magnetic media may be particularly sensitive to oxidation. For process applications involving such sensitive media, trace amounts of argon or other inert gases may be introduced or backfilled into the chamber 12.

For some applications, it is desirable to provide a first orientation to the magnetic media, then rotate the magnetic media from a first position to one or more other positions, and provide other orientations at each position. To accomplish this, the heat exchanger 16 may include a rotation mechanism 56, shown in FIG. 1. The rotation mechanism 56 can rotate a wafer, disk or other magnetic media from a first position to a second position or, if the application requires, to multiple different positions. Rotation mechanisms useful in the invention are known to those skilled in the art.

The invention is also directed to methods of annealing magnetic media with an magnetic annealing oven 10. The method involves loading magnetic media bearing magnetic material to be oriented into the heat exchanger 16 located within the chamber 12 of the oven 10. The door 50 to the oven 10 is closed to create a vacuum seal. The vacuum is ramped up to a vacuum of at least $10^{-7}$ Torr within the chamber 12 and the temperature of the magnetic media is ramped up to a target annealing temperature at a rate consistent with uniform heat transfer to the magnetic media. Power is directed to the magnet 20 of the oven 10 to ramp up to induce a magnetic field of greater than 0.25 Tesla in the magnetic media. The magnetic media is held at the target annealing temperature while maintaining the magnetic field and the vacuum in the chamber 12. The magnetic material of the magnetic media is allowed to assume a desired orientation. Once the desired orientation is achieved, the magnetic media is cooled to about ambient temperature to preserve the desired orientation of the magnetic material. The magnetic field is ramped down and removed and the vacuum is ramped down to gradually reintroduce atmosphere within the chamber 12. The door 50 of the oven 10 can then be opened and the magnetically annealed magnetic media is then unloaded.

For applications where at least a second orientation is to be imparted to the magnetic media, the magnetic media is rotated from a first position to a second position after the magnetic field is ramped down. The vacuum would not be ramped down at this stage. Once the magnetic media has been rotated to a second position, the temperature is again ramped up to a target annealing temperature and the magnetic field is ramped up to induce a magnetic field of greater than 0.25 Tesla in the magnetic media. The magnetic media is held at the target annealing temperature while maintaining the magnetic field and the vacuum in the chamber 12 and the magnetic material of the magnetic media is allowed to assume desired a orientation. Once the desired orientation is achieved, the magnetic media is again cooled to about ambient temperature to preserve the desired orientation of the magnetic material. The magnetic field is ramped down and removed, and the vacuum is ramped down to gradually reintroduce atmosphere within the chamber 12. The door 50 of the oven 10 can then be opened and the magnetically annealed magnetic media is then unloaded. If additional orientations are desired, the magnetic media would be again rotated to a next position after the magnetic media has been cooled down and the magnetic field ramped down, without ramping down the vacuum. The steps from ramping up to a target annealing temperature to cooling down the magnetic media would be repeated. After which the magnetic field would be removed, atmosphere would be reintroduced into the chamber 12, and the magnetically annealed magnetic media would be unloaded.

While exemplary embodiments of this invention and methods of practicing the same have been illustrated and described, it should be understood that various changes, adaptations, and modifications may be made therein without departing from the spirit of the invention and the scope of the appended claims.

What is claimed is:

1. A magnetic annealing oven comprising:

a) a vacuum chamber formed of non-magnetic material and having a vacuum port with a vacuum seal through which magnetic media may be loaded and unloaded;

b) a heat exchanger formed of non-magnetic material and supported in the vacuum chamber, the heat exchanger having a first compartment having an opening for receiving magnetic media to be treated in the oven, and a second compartment in thermally conductive relationship with the first compartment, the second compartment having an airtight volume hermetically sealed from the first compartment and the vacuum chamber, and the heat exchanger being spaced from said vacuum port so as to avoid heating of the vacuum seal to seal-damaging temperatures;

c) heat transfer conduits hermetically sealed from the vacuum chamber and the first compartment for circulating a heat transfer gas to and from the second compartment, and d) an exterior magnet positioned to induce a magnetic field in magnetic media disposed in the heat exchanger.

2. The magnetic annealing oven of claim 1 wherein the opening of the first compartment of the heat exchanger generally faces the vacuum port of the vacuum chamber to facilitate loading and unloading of said first compartment.

3. The magnetic annealing oven of claim 1 wherein said first heat exchanger compartment is at least partially surrounded by said second compartment and wherein said compartments share a common heat-conductive wall for transferring heat between said compartments.

4. The magnetic annealing oven of claim 3 wherein said second compartment comprises an inlet compartment portion and an outlet compartment portion, and a plurality of through-ports extending between said compartment portions for transferring heat thereto.

5. A magnetic annealing oven comprising:

a) a vacuum chamber formed of non-magnetic material adapted to receive and having disposed therein a heat exchanger formed of non-magnetic material and having first and second compartments, the first compartment having an opening for receiving magnetic media, the second compartment having an airtight volume hermetically sealed from the first compartment and the vacuum chamber;

b) a vacuum pump connected to the vacuum chamber, the vacuum pump being capable of providing a vacuum of at least $10^{-7}$ Torr within the chamber;

c) a heat transfer gas unit having heat transfer conduits connected to the second compartment of the heat exchanger to form a heat transfer gas circuit hermetically sealed from the vacuum chamber and the first compartment to supply heating and cooling gas to the second compartment, the first compartment being in thermal communication with the second compartment allowing conductive heat transfer between the gas supplied to the second compartment, the first compartment and the magnetic media disposed therein; and d) a magnet for inducing a magnetic field of greater than 0.25 Tesla in magnetic media disposed in the heat exchanger, the magnet being located exterior to the chamber and positioned to induce the magnetic field along the center line of magnetic media disposed in the heat exchanger.

6. A magnetic annealing oven comprising:

a) a vacuum chamber formed of non-magnetic material, the vacuum chamber having an exterior surface, an interior surface, a vacuum port for loading and unloading of magnetic media, and a rear wall;

b) a door for sealing the vacuum port of the vacuum chamber;

c) a vacuum pump connected to the vacuum chamber, the vacuum pump being capable of providing a vacuum of at least $10^{-7}$ Torr within the chamber;

d) a heat exchanger formed of non-magnetic material and adapted to receive magnetic media, the heat exchanger: having exterior walls, being located within the chamber, and positioned so that there is a gap between the exterior walls of the heat exchanger and the interior surface of the chamber;

e) a heat transfer gas unit connected to the heat exchanger to form a hermetically sealed heat transfer gas circuit; and f) a magnet for inducing a magnetic field of greater than 0.25 Tesla in magnetic media disposed in the heat exchanger, the magnet: being located exterior to the chamber, spaced away from the exterior surface of the chamber, and positioned to induce the magnetic field along the center line of magnetic media loaded in the heat exchanger.

7. The oven of claim 6, wherein the heat exchanger is located near the rear wall of the chamber and the magnet is positioned in proximity to the location of the heat exchanger so as to induce the magnetic field along the center line of magnetic media loaded in the heat exchanger.

8. The oven of claim 6, wherein the door is adapted for vertical movement between open and closed positions.

9. The oven of claim 6, wherein the door is a high vacuum gate valve.

10. The oven of claim 5 or claim 6, wherein the closed heat transfer gas circuit can cycle between room temperature up to a temperature of about 525° C.

11. The oven of any one of claim 1, 5 or 6, wherein the heat exchanger has thermally conductive shelves for holding magnetic media.

12. The oven of any one of claim 1, 5 or 6, wherein the heat exchanger is adapted to receive a carrier having thermally conductive shelves into which magnetic media can be loaded.

13. The oven of any one of claim 1, 5 or 6, wherein the heat exchanger is capable of heating and cooling magnetic media loaded therein through conductive heat transfer.

14. The oven of any one of claim 1, 5 or 6, further comprising a rotation mechanism for rotating magnetic media disposed within the heat exchanger from a first position to at least a second position.

15. The oven of any one of claim 1, 5 or 6, further comprising a temperature controller capable of ramping the temperature of the heat transfer gas at rates consistent with uniform heat transfer to magnetic media loaded in the heat exchanger, a magnetic field controller capable of ramping the magnetic field up to magnetic fields of greater than 0.25 Tesla and gradually removing the magnetic fields; and a vacuum controller capable of ramping up to a vacuum of at least $10^{-7}$ Torr within the chamber and of gradually reintroducing atmosphere into the chamber.

16. The oven of claim 1 or claim 5, wherein the chamber has an interior surface, the interior surface being highly polished so as to provide a low emissivity of less than 0.05.

17. The oven of claim 6, wherein the interior surface of the chamber is highly polished so as to provide a low emissivity of less than 0.05.

18. The oven of any one of claim 1, 5 or 6, further comprising at least one heat reflective shield located between the heat exchanger and the chamber.

19. A oven for annealing of magnetic media comprising:

a) a vacuum chamber formed of non-magnetic material, the chamber having an exterior surface, an interior surface, an opening through which magnetic media can be loaded and unloaded, and a rear wall, b) a door for sealing the opening of the vacuum chamber;

c) a heat exchanger formed of thermally conductive, non-magnetic material and adapted to receive magnetic media, the heat exchanger having exterior walls and being positioned within the chamber so that there is a gap between the exterior walls of the heat exchanger and the interior surface of the chamber, and adapted for hermetically sealed connection to a heat transfer gas unit external to the chamber;

d) a magnet capable of inducing a magnetic field of greater than 0.25 Tesla in magnetic media loaded in the heat exchanger, the magnet being located exterior to the chamber, spaced rearwardly of the door in proximity to the heat exchanger, and positioned to induce the magnetic field along the center line of magnetic media loaded in the heat exchanger;

e) a heat transfer gas unit located external to the chamber and connected to the heat exchanger for providing heat transfer gas to the heat exchanger at high pressure, the heat transfer gas unit being capable of heating and cooling the heat transfer gas consistent with uniform heat transfer to magnetic media; and f) a vacuum pump for providing a vacuum of at least $10^{-7}$ Torr within the chamber, the pump being connected to the chamber.

20. A oven for annealing of magnetic media comprising:

a) a vacuum chamber formed of non-magnetic material, the chamber having an exterior surface, an interior surface, an opening through which magnetic media can be loaded and unloaded, and a rear wall;

b) a door for sealing the opening of the vacuum chamber;

c) a carrier into which magnetic media can be loaded, the carrier being formed of thermally conductive, non-magnetic material;

d) a heat exchanger formed of thermally conductive, non-magnetic material and adapted to receive and to cooperate with the carrier to heat and cool magnetic media loaded therein through thermal conductive heat transfer, the heat exchanger having exterior walls and being located within and an integral part of the chamber, with a gap between the exterior walls of the heat exchanger and the interior surface of the chamber, and adapted for hermetically sealed connection to a heat transfer gas unit external to the chamber;

e) a magnet capable of inducing a magnetic field of greater than 0.25 Tesla in magnetic media loaded in the heat exchanger, the magnet being located exterior to the chamber, spaced rearwardly of the door in proximity to the heat exchanger, and positioned to induce the magnetic field along the center line of magnetic media loaded in the heat exchanger;

f) a heat transfer gas unit located external to the chamber and connected to the heat exchange for providing heat transfer gas to the heat exchanger at high pressure, the heat transfer gas unit being capable of heating and cooling the heat transfer gas consistent with uniform heat transfer to magnetic media; and g) a vacuum pump for providing a vacuum of at least $10^{-7}$ Torr within the chamber, the pump being connected to the chamber.

21. The oven of any one of claim 1, 5, 6, 19 or 20, wherein the magnet is a permanent magnet, an electro-magnet, or a superconducting electromagnet.

22. A method of magnetic annealing magnetic media comprising the steps of:

a) providing a magnetic annealing oven, the oven having:

(i) a vacuum chamber formed of non-magnetic material and adapted to receive and having disposed therein a heat exchanger formed of non-magnetic material, the heat exchanger having first and second compartments, the first compartment being adapted to receive magnetic media, the second compartment having an airtight volume hermetically sealed from the first compartment and the vacuum chamber;

(ii) a vacuum pump connected to the vacuum chamber, the vacuum pump being capable of providing a vacuum of at least $10^{-7}$ Torr within the chamber;

(iii) a heat transfer gas unit having heat transfer conduits connected to the second compartment of the heat exchanger to form a heat transfer gas circuit hermetically sealed from the vacuum chamber and the first compartment, the conduits supplying heating and cooling gas to the second compartment, the first compartment being in thermal communication with the second compartment allowing conductive heat transfer between the gas supplied to the second compartment, the first compartment and the magnetic media disposed therein; and (iv) a magnet for inducing a magnetic field of greater than 0.25 Tesla in magnetic media disposed in the heat exchanger, the magnet being located exterior to the chamber and positioned to induce the magnetic field along the center line of magnetic media disposed in the heat exchanger;

c) sealing the chamber to create a vacuum seal;

d) ramping up to a vacuum of at least $10^{-7}$ Torr within the chamber;

e) ramping the temperature of the magnetic media up to a target annealing temperature at a rate consistent with uniform heat transfer to the magnetic media;

f) ramping up the magnetic field so as to induce a magnetic field of greater than 1 Tesla in the magnetic media;

g) holding the magnetic media at the target annealing temperature while maintaining the magnetic field and the vacuum in the chamber;

h) allowing the magnetic material of the magnetic media to assume desired a orientation;

i) cooling the magnetic media to about ambient temperature to preserve the desired orientation of the magnetic material;

j) ramping down and removing the magnetic field;

k) ramping down the vacuum to gradually reintroduce atmosphere within the chamber; and l) unloading the magnetic media.

23. A method of magnetic annealing magnetic media comprising the steps of:

a) providing an oven according to anyone of claim 1, 5, 6, 19 or 20 having a chamber, a door and a heat exchanger located in the chamber;

b) loading magnetic media into the heat exchanger within the chamber of the oven, the magnetic media bearing magnetic material to be oriented;

c) closing the door to create a vacuum seal;

e) ramping up to a vacuum of at least $10^{-7}$ Torr within the chamber;

f) ramping the temperature of the magnetic media up to a target annealing temperature at a rate consistent with uniform heat transfer to the magnetic media;

g) ramping up the magnetic field so as to induce a magnetic field of greater than 0.25 Tesla in the magnetic media;

h) holding the magnetic media at the target annealing temperature while maintaining the magnetic field and the vacuum in the chamber;

i) allowing the magnetic material of the magnetic media to assume desired a orientation;

j) cooling the magnetic media to about ambient temperature to preserve the desired orientation of the magnetic material.

k) ramping down and removing the magnetic field;

l) ramping down the vacuum to gradually reintroduce atmosphere within the chamber; and m) unloading the magnetic media.

24. A method of magnetic annealing magnetic media comprising the steps of:

a) providing an oven according to anyone of claim 1, 5, 6, 19 or 20 having a chamber, and a heat exchanger located in the chamber;

b) loading magnetic media into the heat exchanger within the chamber of the oven, the magnetic media bearing magnetic material to be oriented;

c) sealing the chamber to create a vacuum seal;

d) ramping up to a vacuum of at least $10^{-7}$ Torr within the chamber;

e) ramping the temperature of the magnetic media up to a target annealing temperature at a rate consistent with uniform heat transfer to the magnetic media;

f) ramping up the magnetic field so as to induce a magnetic field of greater than 0.25 Tesla in the magnetic media;

g) holding the magnetic media at the target annealing temperature while maintaining the magnetic field and the vacuum in the chamber;

h) allowing the magnetic material of the magnetic media to assume desired a orientation;

i) cooling the magnetic media to about ambient temperature to preserve the desired orientation of the magnetic material;

j) ramping down and removing the magnetic field;

k) rotating the magnetic media from a first position to a second position;

l) repeating steps e) to j);

m) ramping down the vacuum to gradually reintroduce atmosphere within the chamber; and n) unloading the magnetic media.

* * * * *